US006415923B1

(12) United States Patent
Chen

(10) Patent No.: US 6,415,923 B1
(45) Date of Patent: Jul. 9, 2002

(54) TOOL BOX HAVING PIVOTABLE BIT RECEIVING MEMBERS

(76) Inventor: Chang-Ying Chen, No. 5, 320 Alley, Shi Hu Road, Ta Li Hsiang, Taichung Hsien (TW)

( * ) Notice: Subject to any disclaimer, the term of this patent is extended or adjusted under 35 U.S.C. 154(b) by 0 days.

(21) Appl. No.: 09/836,257

(22) Filed: Apr. 18, 2001

(51) Int. Cl.[7] ..... B65D 85/20; B65D 1/34; B65D 5/50

(52) U.S. Cl. ..... 206/379; 206/372; 206/565; 206/749; 206/759

(58) Field of Search ..... 206/372, 376–379, 206/558, 559, 565, 743, 745, 747–749, 759

(56) References Cited

U.S. PATENT DOCUMENTS 1,467,805 A * 9/1923 Meyberg ..... 206/743
4,026,395 A * 5/1977 Johnson ..... 206/559
5,711,428 A * 1/1998 Ho ..... 206/759
5,951,385 A * 9/1999 Newhouse et al. ..... 206/372
6,105,770 A * 8/2000 Vasudeva ..... 206/379

* cited by examiner

*Primary Examiner*—Bryon P. Gehman
(74) *Attorney, Agent, or Firm*—Rosenberg, Klein & Lee

(57) ABSTRACT

A tool box includes a base having a plurality of receiving members pivotally connected between two side walls of the base and each of the receiving members has a shaft. A gear is connected to an end of each of the shafts and a rack is movably connected to the base. The gears are rotatably engaged with the rack. A cover is pivotally connected to the base by a pivot axle and a driving gear is connected to the pivot axle and engaged with the rack so that when opening the cover, the receiving members are pivoted and the bits in the receiving members are pivoted toward the users.

3 Claims, 5 Drawing Sheets

TOOL BOX HAVING PIVOTABLE BIT RECEIVING MEMBERS

FIELD OF THE INVENTION

The present invention relates to a tool box having a rack in the base and a plurality of bit receiving members each have a gear engaged with the rack so that the bit receiving members are pivoted when the tool box is opened and closed.

BACKGROUND OF THE INVENTION

A conventional tool box generally includes a base and a cover which is pivotally connected to the base. The base has a plurality of recesses defined therein so as to receive tools or bits therein. The cover prevents the bits or tools from dropping from recesses when carrying the tool box. The users have to insert fingers in a gap between the bits and the inside of the recesses and pick the bits or tools from the recesses. The recesses are defined in the surface of the base so that the bits or the tools are securely received horizontally in the recesses. The receiving status of the bits or the tools is not convenient for the users to pick.

The present invention intends to provide a tool box wherein the bit receiving members are pivoted together with the opening action of the tool box.

SUMMARY OF THE INVENTION

In accordance with one aspect of the present invention, there is provided a tool box and comprises a base has a plurality of receiving members and each of the receiving members has a shaft. A gear is connected to an end of each of the shafts and a rack is movably connected to the base. The gears are rotatably engaged with the rack. A cover is pivotally connected to the base by a pivot axle and a driving gear is connected to the pivot axle and engaged with the rack.

The primary object of the present invention is to provide a tool box that has pivotable receiving members for receiving bits therein and the receiving members are pivoted in an upright position when the cover of the tool box is opened.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
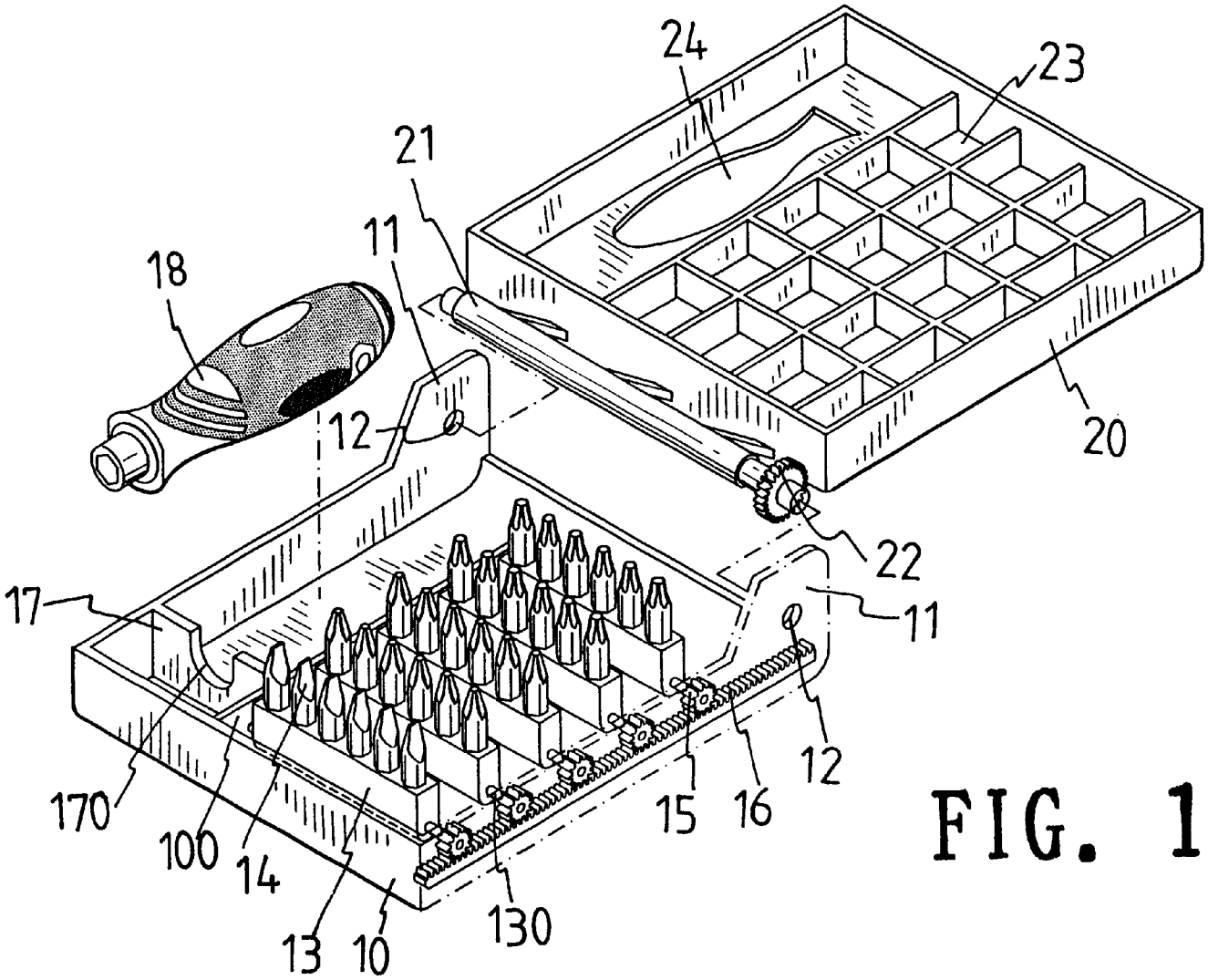
FIG. 1 is an exploded view to show a tool box of the present invention.
Figure 2:
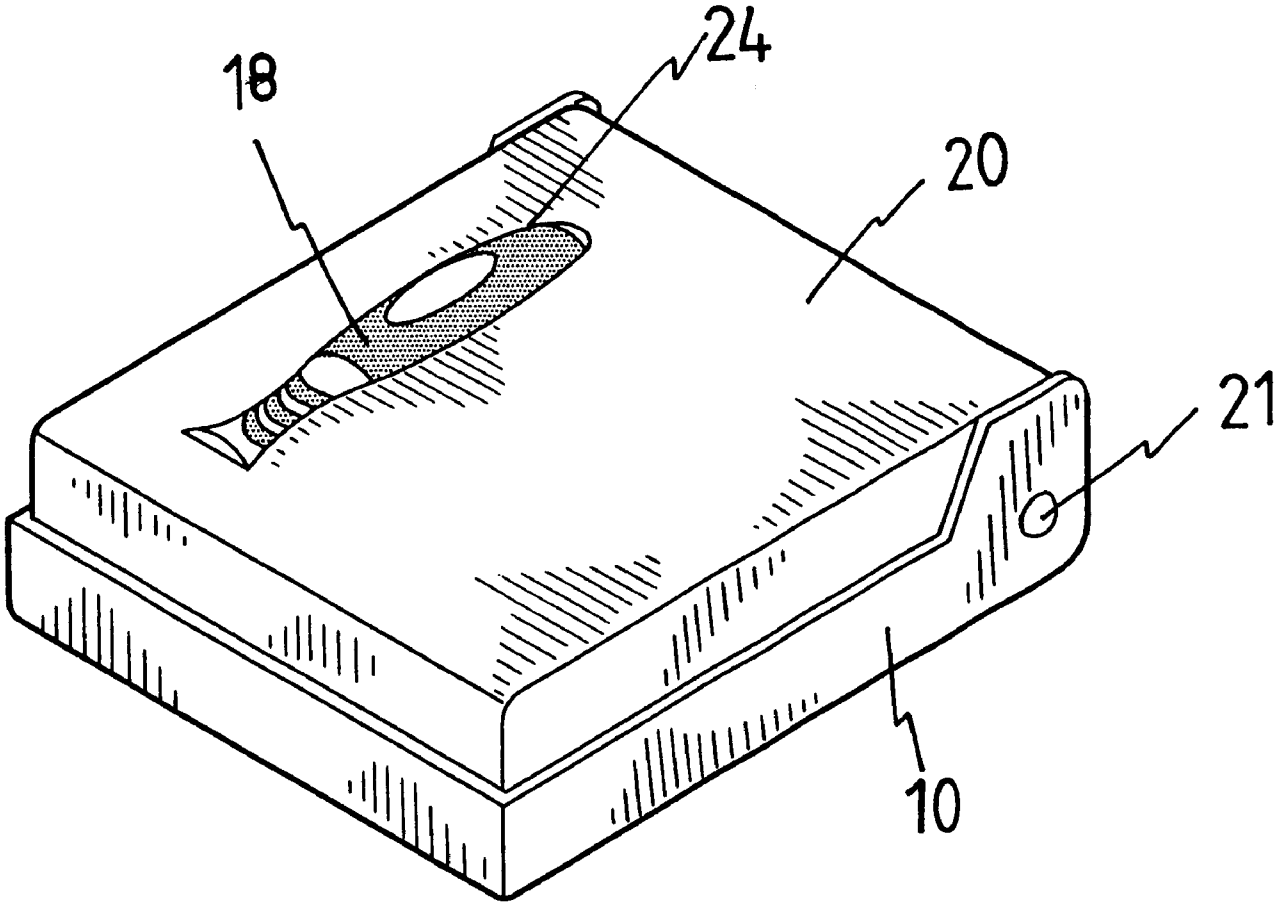
FIG. 2 is a perspective view to show the tool box of the present invention.
Figure 4:
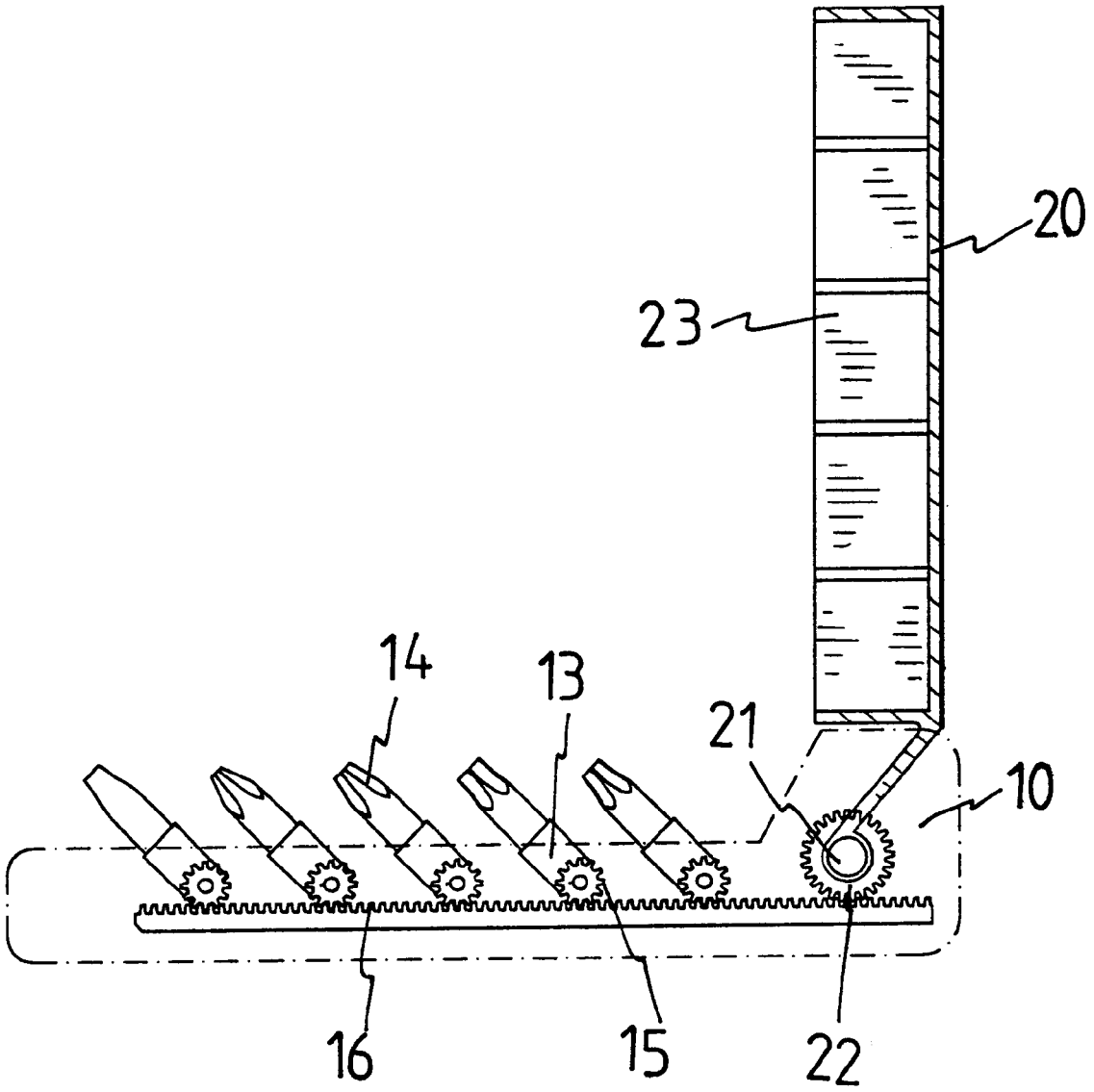
FIG. 4 is a side view to show that the receiving members are pivoted when the cover is pivoted to an upright position.

Referring to FIGS. 1, 2 and 4, the tool box of the present invention comprises a base 10 which has a first separation board 100 and a plurality of receiving members 13 are pivotally connected between the first separation board 100 and a sidewall of the base. Each of the receiving members 13 receives six bits 14 and a shaft 130 extends through each of the receiving members 13. One end of each of the shafts 130 is rotatably engaged with the first separation board 100 and the other end of each of the shafts 130 has a gear 15 connected thereto. A rack 16 is movably connected to the base 10 and located beside the sidewall and the gears 15 are rotatably engaged with the rack 16. Two lugs 11 extend from the base 10 and each of the lugs 11 has a hole 12 defined therethrough. The base 10 has a second separation board 17 and a recess 171 is defined in the second separation board 17 so that a screwdriver handle 18 has an end engaged with the recess 171.

A cover 20 pivotally connected to the base 10 by a pivot axle 21 which are connected between the two lugs 11 by extending through the two respective holes 12. A driving gear 22 is connected to the pivot axle and engaged with the rack 16. A slot 24 is defined through the cover 20 so that the screwdriver handle 18 is accessed via the slot 24. A plurality of partitions 23 are defined in the cover 20 so that tiny parts can be received in the partitions 23. When opening the cover 20 to an upright position as shown in FIG. 4, the driving gear 22 moves the rack 16 and the gears 15 are rotated so that the receiving members 13 are pivoted toward the user.

Figure 3:
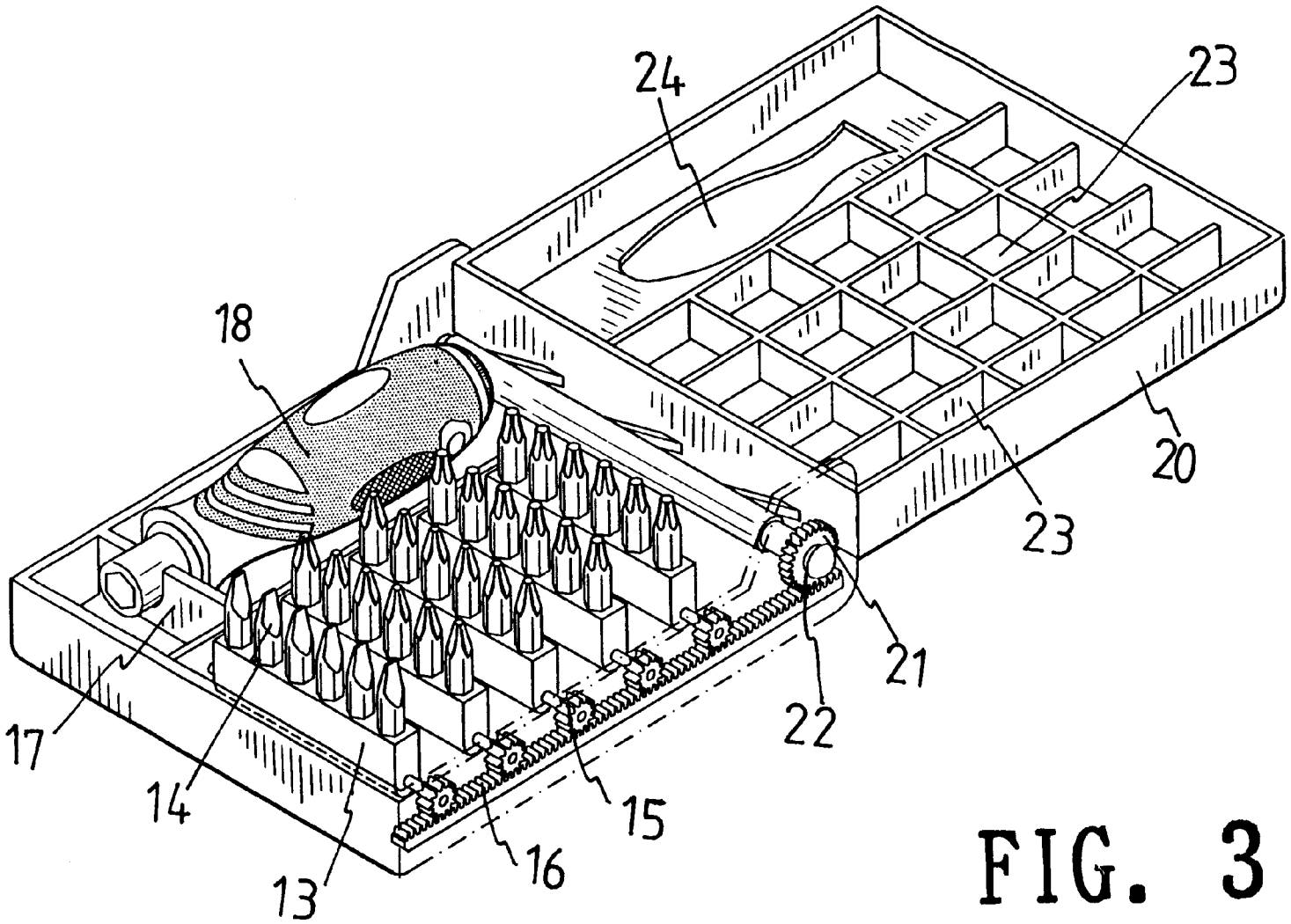
FIG. 3 is a perspective view to show the tool box of the present invention wherein the cover is in an open status.
Figure 5:
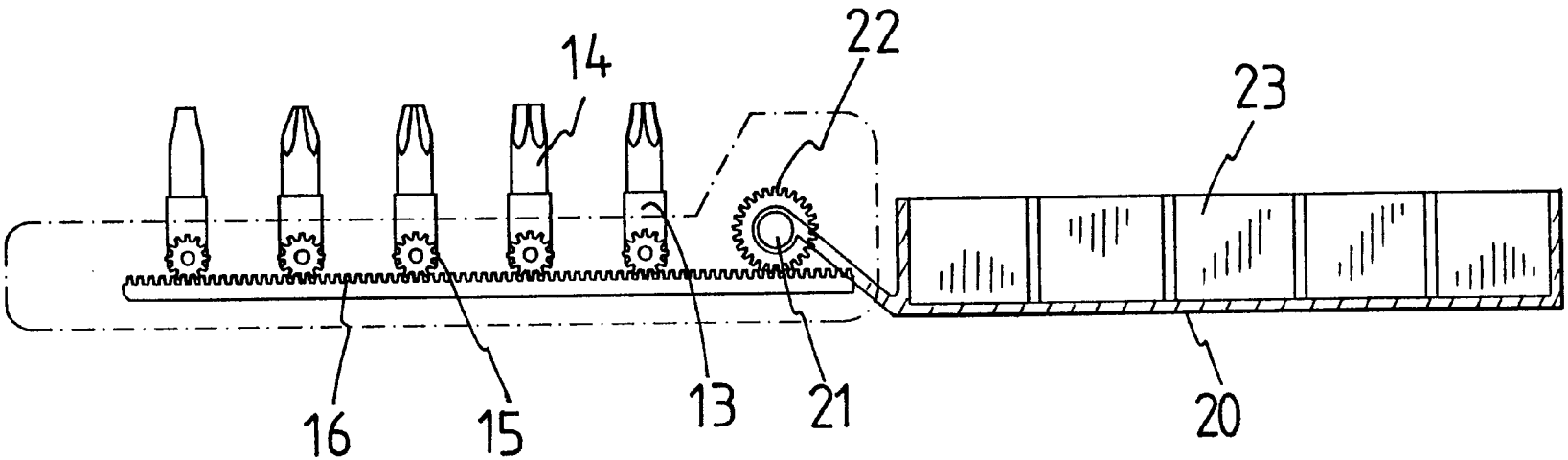
FIG. 5 is a side view to show that the receiving members are pivoted to an upright position when the cover is pivoted to a horizontal position.

As shown in FIGS. 3 and 5, when the cover 20 is continued to be pivoted to a horizontal position, the receiving members 13 are pivoted to an upright position and the user is easily and conveniently to pick the bits 14 from the receiving members 13.

The pivotable receiving members 13 are lied in the base 10 when the tool box is closed so that the thickness of the tool box is thin. When opening the cover 20, the receiving members 13 are pivoted to the upright position which is convenient for the users to pick desired bits 14.

While we have shown and described the embodiment in accordance with the present invention, it should be clear to those skilled in the art that further embodiments may be made without departing from the scope of the present invention.

What is claimed is:

1. A tool box comprising:

a base having a plurality of receiving members and each of said receiving members having a shaft, a respective gear connected to an end of each of said shafts and a rack connected to and movable with respect to said base, said gears engaged with said rack to rotate when said rack is moved, and a cover pivotally connected to said base by a pivot axle, a driving gear connected to said pivot axle and engaged with said rack to move said rack.

2. The tool box as claimed in claim 1, wherein said base has a separation board and a recess is defined in said board.

3. The tool box as claimed in claim 1, wherein said base has two lugs extending therefrom and said pivot axle is connected between said two lugs.

* * * * *